US010436013B2

(12) United States Patent
Lange

(10) Patent No.: US 10,436,013 B2
(45) Date of Patent: Oct. 8, 2019

(54) BEND MEASUREMENTS OF ADJUSTABLE MOTOR ASSEMBLIES USING INCLINOMETERS

(71) Applicant: HALLIBURTON ENERGY SERVICES, INC., Houston, TX (US)

(72) Inventor: Gustav Edward Lange, Millet (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 269 days.

(21) Appl. No.: 15/026,702

(22) PCT Filed: Dec. 31, 2013

(86) PCT No.: PCT/US2013/078424

§ 371 (c)(1),
(2) Date: Apr. 1, 2016

(87) PCT Pub. No.: WO2015/102602

PCT Pub. Date: Jul. 9, 2015

(65) Prior Publication Data

US 2016/0237806 A1 Aug. 18, 2016

(51) Int. Cl.
*E21B 47/024* (2006.01)
*E21B 47/01* (2012.01)
(Continued)

(52) U.S. Cl.
CPC ..... *E21B 47/024* (2013.01); *E21B 7/067* (2013.01); *E21B 7/068* (2013.01); *E21B 44/005* (2013.01); *E21B 47/01* (2013.01); *E21B 47/12* (2013.01)

(58) Field of Classification Search
CPC ..... E21B 7/067; E21B 47/02; E21B 47/024; E21B 7/04–10
(Continued)

(56) References Cited

U.S. PATENT DOCUMENTS 2,943,397 A 7/1960 Ring et al.
4,303,994 A 12/1981 Tanguy et al.
(Continued)

FOREIGN PATENT DOCUMENTS

WO 0129371 4/2001

OTHER PUBLICATIONS

International Patent Application No. PCT/US2013/078424, International Search Report and Written Opinion, dated Sep. 29, 2014, 18 pages.

(Continued)

*Primary Examiner* — Giovanna C Wright
*Assistant Examiner* — Jonathan Malikasim
(74) *Attorney, Agent, or Firm* — Kilpatrick Townsend and Stockton LLP

(57) ABSTRACT

A wellbore assembly is provided that can include a first motor housing assembly member and a second motor housing assembly member that can bend relative to the first motor housing assembly at a bend location. The assembly can also include a first inclinometer positioned on assembly side of the bend location to determine a first inclination and a second inclinometer positioned on a second side of the bend location to determine a second inclination. Based on the first and second inclinations, the amount of bend or bend direction of the second motor housing assembly member relative to the first motor housing assembly member can be determined.

25 Claims, 6 Drawing Sheets

(51) Int. Cl.
*E21B 7/06* (2006.01)
*E21B 44/00* (2006.01)
*E21B 47/12* (2012.01)

(58) Field of Classification Search
USPC ..... 175/45
See application file for complete search history.

(56) References Cited

U.S. PATENT DOCUMENTS 4,324,297 A 4/1982 Denison et al.
4,407,374 A 10/1983 Wallussek et al.
4,445,578 A 5/1984 Millheim et al.
4,880,066 A 11/1989 Steiginga et al.
4,894,923 A 1/1990 Cobern et al.
5,117,927 A 6/1992 Askew
5,194,859 A 3/1993 Warren et al.
5,269,383 A * 12/1993 Forrest ..... E21B 4/02 175/106
5,394,951 A 3/1995 Pringle et al.
5,602,541 A 2/1997 Wallis et al.
5,646,611 A 7/1997 Dailey et al.
6,068,394 A 5/2000 Dublin et al.
6,192,748 B1 2/2001 Miller et al.
6,273,189 B1 8/2001 Gissler et al.
6,405,808 B1 6/2002 Lovell et al.
6,585,061 B2 7/2003 Radzinski et al.
6,877,241 B2 4/2005 Barr et al.
7,114,565 B2 10/2006 Estes et al.
7,503,403 B2 3/2009 Jogi et al.
7,506,696 B2 3/2009 Weston et al.
7,556,105 B2 7/2009 Krueger et al.
7,725,263 B2 5/2010 Sugiura et al.
7,870,912 B2 1/2011 Dolgin et al.
7,882,904 B2 2/2011 von Gynz-Rekowski et al.
8,151,907 B2 * 4/2012 MacDonald ..... C10G 21/22 175/26
8,220,540 B2 * 7/2012 Freyer ..... E21B 7/062 166/250.01
8,302,705 B2 11/2012 Downton
8,360,172 B2 1/2013 Santelmann
8,428,879 B2 4/2013 Ekseth et al.
8,434,567 B2 5/2013 Menezes et al.
2003/0094310 A1 5/2003 Eppink et al.
2005/0109097 A1 5/2005 Bogath et al.
2005/0161258 A1 7/2005 Lockerd et al.
2006/0045408 A1 3/2006 Jones et al.
2006/0157278 A1 7/2006 Dolgin et al.
2007/0175639 A1 8/2007 Hoen et al.
2008/0035376 A1 2/2008 Freyer et al.
2009/0260823 A1 10/2009 Prince-Wright et al.
2011/0162891 A1 7/2011 Camp et al.
2011/0284292 A1 11/2011 Gibb et al.
2012/0013339 A1 1/2012 Kuckes
2012/0143521 A1 6/2012 Chen et al.
2012/0205154 A1 8/2012 Lozinsky et al.
2013/0292176 A1 11/2013 Ekseth et al.
2013/0304384 A1 * 11/2013 Rabinovich ..... E21B 47/026 702/6
2014/0196953 A1 7/2014 Chitwood et al.
2016/0040525 A1 2/2016 Lange et al.

OTHER PUBLICATIONS

U.S. Appl. No. 14/430,068, Non-Final Office Action, dated Apr. 21, 2017, 9 Pages.
Canadian Application No. CA2,931,801 , "Office Action", dated Apr. 2, 2019, 4 pages.

* cited by examiner

BEND MEASUREMENTS OF ADJUSTABLE MOTOR ASSEMBLIES USING INCLINOMETERS

CROSS-REFERENCE TO RELATED APPLICATIONS

This is a U.S. national phase under 35 U.S.C. § 371 of International Patent Application No. PCT/US2013/078424, titled "Bend Measurements of Adjustable Motor Assemblies Using Inclinometers" and filed Dec. 31, 2013, the entirety of which is incorporated herein by reference.

TECHNICAL FIELD

The present disclosure relates generally to devices for use in well systems. More specifically, but not by way of limitation, this disclosure relates to measuring a bend of an adjustable motor assembly using one or more inclinometers.

BACKGROUND

A well system (e.g., oil or gas wells for extracting fluids from a subterranean formation) can include a drill string for forming a wellbore. A drill string can include a bottom hole assembly with a drill bit, stabilizers, a downhole motor, or other components.

A drill string can be used to drill a directional (or deviated) wellbore that is not vertical in its entirety. Directional wellbores can enhance production of the wellbores. To obtain an angle of inclination to drill directional wells, downhole drilling motors can include adjustable housing assemblies. An adjustable housing assembly can allow the drill operator to change the inclination of a housing assembly without replacing the entire bent housing section. An amount of bend downhole of an adjustable housing assembly can be challenging to obtain.

DETAILED DESCRIPTION

Figure 1:
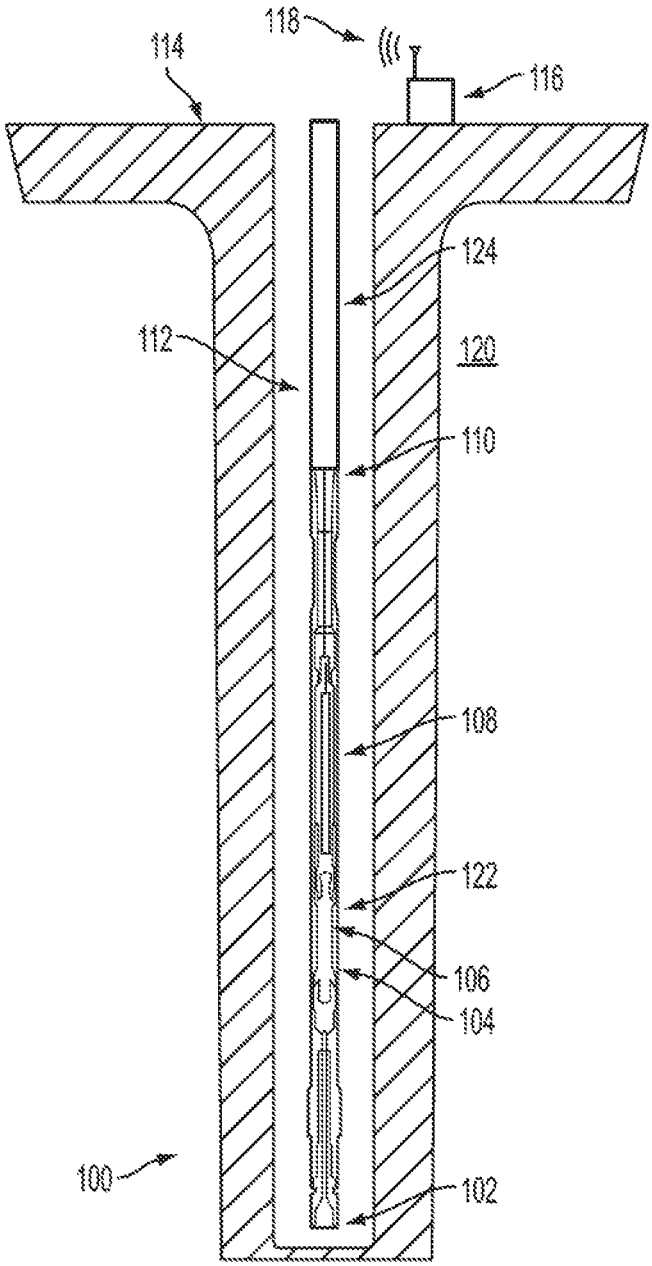
FIG. 1 is a cross-sectional side view of one embodiment of a system that can include an adjustable motor assembly for which bend measurements can be determined using inclinometers according to one aspect of the present disclosure.

Certain aspects and features of the present disclosure are directed to determining bend measurements of adjustable motor assemblies using inclinometers. The adjustable motor assembly can include a first motor housing assembly member. The adjustable motor assembly can further include a second motor housing assembly member. The second motor housing assembly member can be coupled to the first motor housing assembly member so that the first motor housing assembly member can bend relative to the second motor housing assembly member at a bend location in a wellbore. The adjustable motor assembly can also include a first inclinometer and a second inclinometer. In one embodiment, the first inclinometer can be positioned on the first motor housing assembly member to determine a first inclination. The second inclinometer can be positioned on the second motor housing assembly member to determine a second inclination.

In another embodiment, the adjustable motor assembly can further include a third motor assembly member located inside the first or second motor housing assembly members. The third motor assembly member can be a mandrel. In one such embodiment, a first inclinometer can be positioned on the third motor assembly member on a first side of a bend location to determine a first inclination. Likewise, the second inclinometer can be positioned on the third motor assembly member on a second side of a bend location to determine a second inclination. In another embodiment, the first inclinometer can be positioned on the first or second motor housing assembly members to determine a first inclination. The second inclinometer can be positioned on the third motor assembly member to determine a second inclination. In some embodiments, the third motor assembly member can rotate around a rotation axis.

The inclination detected by the second inclinometer can change as the first motor housing assembly member bends relative to the second motor housing assembly member. The changed second inclinometer measurement can be used to determine the amount of bend or bend direction of the first motor housing assembly member relative to the second motor housing assembly member.

In one example, an adjustable motor assembly can be a part of a bottom hole drilling assembly deployed in a wellbore. The first and second motor housing assembly members can be drill motor housing assembly members of the adjustable motor assembly. A drill operator can cause the adjustable motor assembly to bend at a bend location in the wellbore such that a first motor housing assembly member bends relative to a second motor housing assembly member at the bend location. As the first housing member bends relative to the second housing member, the inclination of the second inclinometer can change. The measurements from the first inclinometer and second inclinometer can be used to determine the amount of bend and, in some embodiments, the bend direction of the first motor housing member relative to the second motor housing member. Assemblies according to some embodiments can allow the drill operator to confirm that the adjustable motor assembly is functioning properly or predict how the bottom hole assembly will perform in a formation.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional side view of one embodiment of a system 100 that can include an adjustable motor assembly 122 for which bend measurements can be determined using inclinometers. In this example, the system 100 is a well system (e.g., an oil or gas well for extracting fluids from a subterranean formation). The system 100 can include a wellbore 112 drilled out of a formation 120 from a surface 114. A drill string 124, which can contain a bottom hole assembly, for drilling can be located in the wellbore 112. The bottom hole assembly can include an upper connection 110, a power section 108, and a drill bit 102. The power section 108 can include a motor assembly 122 with an adjustable housing 104 that can bend at a bend location 106.

The system 100 can also include a computing device 116 for receiving a first inclinometer measurement, a second inclinometer measurement, a bend measurement, or a direction measurement. The computing device 116 can be positioned at the wellbore surface 114, below ground, or offsite. The computing device 116 can include a processor interfaced with other hardware via a bus. A memory, which can include any suitable tangible (and non-transitory) computer-readable medium such as RAM, ROM, EEPROM, or the like, can embody program components that configure operation of the computing device 116. In this example, the computing device 116 can further include input/output interface components and additional storage.

The computing device 116 can receive a first inclinometer measurement, a second inclinometer measurement, a bend measurement, or a direction measurement via a communication device 118. The communication device 118 can represent one or more of any components that facilitate a network connection. In this example, the communication device 118 is wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In other embodiments, the communication device 118 can be wired and can include interfaces such as Ethernet, USB, or IEEE 1394.

In some embodiments, the computing device 116 can receive the amount of bend and bend direction via a communication device 118, or determine the amount of bend and bend direction, and compare it with a designated drilling trajectory. Should the amount of bend and bend direction need to be altered to conform with the designated drilling trajectory, the computing device 116 can cause the amount of bend or bend direction of the second motor housing assembly member relative to the first motor housing assembly member to change.

Figure 2A:
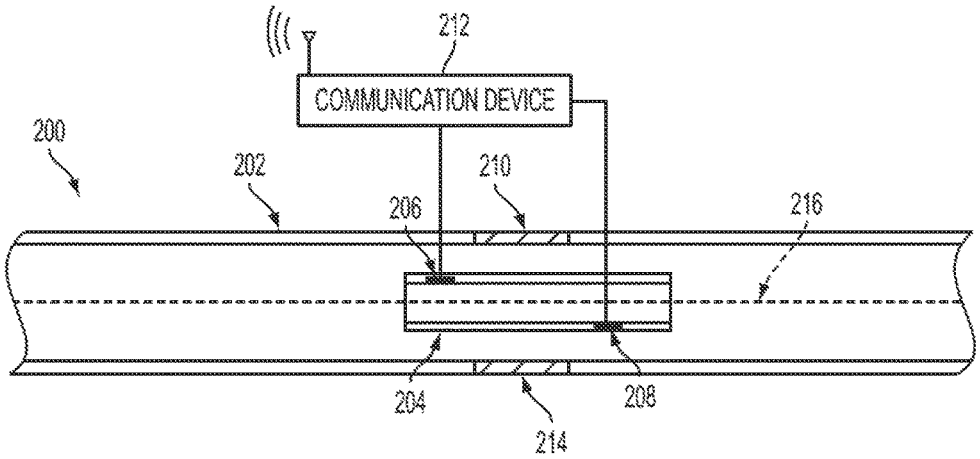
FIG. 2A is a cross-sectional side view of one embodiment of an assembly for determining bend measurements of an adjustable motor assembly using inclinometers according to one aspect of the present disclosure.

FIG. 2A is a cross-sectional side view of one embodiment of an assembly for determining bend measurements of an adjustable motor assembly 200 using inclinometers 206 and 208. The adjustable motor assembly 200 can include a housing 202 that can bend via an adjustable ring 210. The adjustable motor assembly 200 can include a mandrel 204 inside the housing 202. The adjustable motor assembly 200 can further include a first inclinometer 206 positioned on the mandrel 204 on a first side of a bend location 214 for determining a first inclination. Likewise, the second inclinometer 208 can be positioned on the mandrel 204 on a second side of the bend location 214 for determining a second inclination. As the housing 202 bends, the inclination measured by the second inclinometer 208 can change. The changed measurement can be used to determine an amount of bend in or bend direction of the adjustable motor assembly 200.

The inclinometers 206 and 208 according to some embodiments can include an accelerometer. Inclinometers 206 and 208 according to other embodiments can include a capacitor, microelectromechanical systems (MEMS), a ball or bubble in liquid, a pendulum, a photodetector, a light-emitting diode, or an electrolytic fluid. In some embodiments, the inclinometers 206 and 208 can include multiple inclination or slope sensors and may be able to determine an angle of inclination in multiple dimensions. For example, inclinometers 206 and 208 may include a two-axis MEMS sensor, which senses acceleration caused by gravity in two orthogonal directions. Further, the inclinometers 206 and 208 may include one or more of a processor, a microcontroller, memory, a bus, or a filter. In some such embodiments, the filter can remove background vibrations or other noise from the inclinometer angle measurement.

In some embodiments, the first inclinometer 206 or second inclinometer 208 can include a communication device 212 for communicating with a computing device, e.g. computing device 116 depicted in FIG. 1. The communication device 212 can be internal or external to the inclinometers 206, 208. In such an embodiment, the computing device 116 can determine one or both of a bend direction and a bend amount based on changes in angles of inclination. In one embodiment, the computing device 116 can determine the angle of inclination of a motor housing assembly member with respect to gravity by determining an inclination angle measurement from inclinometers 206, 208. In another embodiment, the computing device 116 can determine the angle of inclination of the second motor housing assembly member with respect to the first motor housing assembly member by determining a first set of inclination angle measurements at the respective inclinometers 206, 208. The computing device 116 can determine a first difference between the angle measurements of the respective inclinometers 206, 208. The computing device 116 can associate the first difference between angle measurements with a first bend amount (e.g., an absence of bending in any direction for an un-bent motor assembly 122) of the second motor housing assembly member with respect to the first motor housing assembly member. Further, the computing device 116 can determine a second set of inclination angle measurements at the respective inclinometers 206, 208 based on a bending of the motor assembly 122. The computing device 116 can determine a second difference between the angle measurements of the respective inclinometers 206, 208. A change in the difference between angle measurements can be used to determine a bend amount for the motor assembly 122.

In some embodiments, computing device 116 can further determine a bend direction. In one such embodiment, each inclination angle measurement from a respective one of the inclinometers 206, 208 describes an inclination angle in three dimensions. The computing device 116 can determine the bend direction of the first motor housing assembly member relative to the second motor housing assembly member by comparing the inclination angle measurements from the respective inclinometers 206, 208.

Figure 2B:
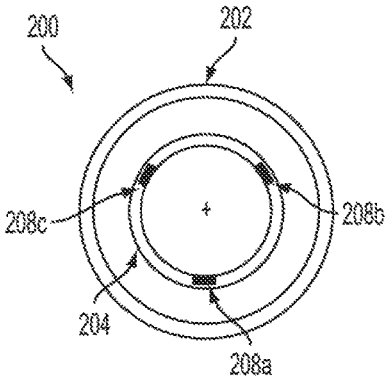
FIG. 2B is a cross-sectional end view of the embodiment in FIG. 2A in which there are multiple inclinometers positioned around the circumference of a mandrel according to one aspect of the present disclosure.

In other embodiments, each inclination angle measurement from a respective one of the inclinometers 206, 208 describes an inclination angle in one or two dimensions. In such an embodiment, multiple inclinometers can be positioned around the circumference of the mandrel 204, as shown in FIG. 2B. FIG. 2B is a cross-sectional end view of the embodiment in FIG. 2A in which there are multiple inclinometers 208*a-c* positioned around the circumference of the mandrel 204. In some embodiments, such as the embodiment shown in FIG. 2B, multiple inclinometers 208*a-c* are equally spaced around the circumference of the mandrel 204. In other embodiments, multiple inclinometers 208*a-c* may be unequally spaced around the circumference of the mandrel 204. Further, in some embodiments, multiple inclinometers 208*a-c* may be equally or unequally spaced around the circumference of the housing 202.

Figure 2C:
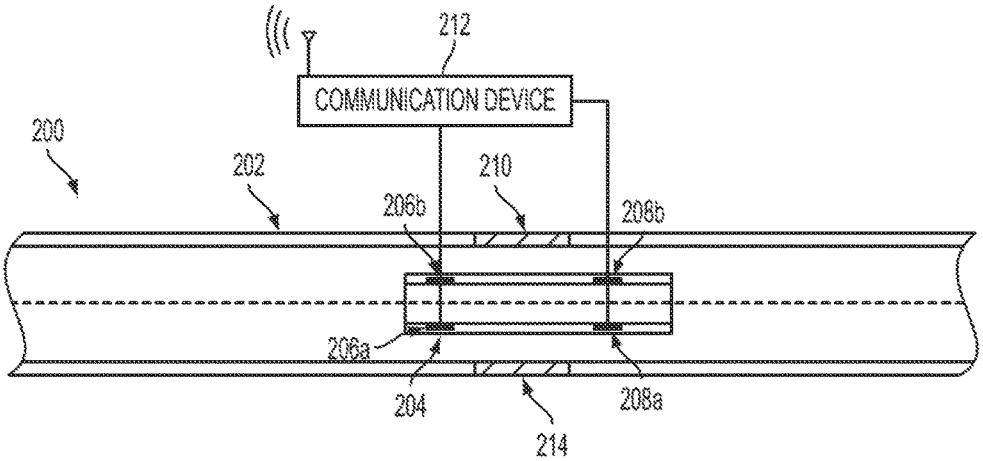
FIG. 2C is a cross-sectional side view of the embodiment in FIG. 2A in which there are multiple inclinometers positioned around the circumference of a mandrel according to one aspect of the present disclosure.

As shown in FIG. 2C, multiple inclinometers 206*a-b* can be positioned on a first side of the bend location and multiple inclinometers 208*a-b* can be positioned on a second side of the bend location. Inclination measurements from different inclinometers 206*a-b*, 208*a-b* can be used to determine respective bend amounts in different planes. For example, a first difference between inclination measurements from 206*a*, 208*a* can identify a bend amount with respect to a first plane, and a second difference between inclination measurements from 206*b*, 208*b* can identify a bend amount with respect to a second plane. In such an embodiment, computing device 116 can combine the bend amounts from each inclinometer 206*a-b*, 208*a-b* to determine a bend direction of the first motor housing assembly member relative to the second motor housing assembly member.

Figure 3:
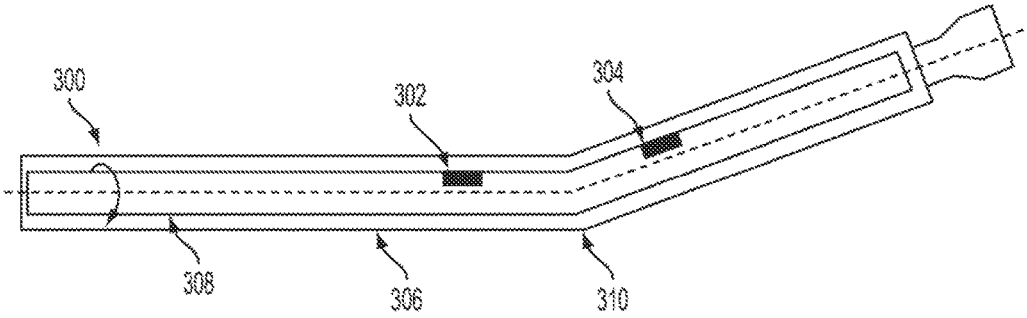
FIG. 3 is a cross-sectional side view of another embodiment of an assembly for determining bend measurements of an adjustable motor assembly using inclinometers in which the inclinometers are positioned on a rotating shaft according to one aspect of the present disclosure.

FIG. 3 is a cross-sectional side view of another embodiment of an assembly for determining bend measurements of an adjustable motor assembly 300 using inclinometers 302, 304 in which the inclinometers 302, 304 are positioned on a rotating shaft. In such an embodiments, a first inclinometer 302 can be positioned on a rotating shaft 308 inside the housing 306 for determining a first inclination on a first side of a bend location 310. The rotating shaft 308 can rotate around a rotational axis. Similarly, in some embodiments, second inclinometer 304 can be positioned on the rotating shaft 308 for determining a second inclination on a second side of the bend location 310.

As the shaft 308 rotates, the inclination angle measurements from inclinometers 302, 304 may change. In such an embodiment, the computing device 116 can determine one or both of a bend direction and a bend amount based on changes in angles of inclination. The computing device 116 can determine a first difference between the angle measurements of the respective inclinometers 302, 304 at any given point in the rotation cycle. The computing device 116 can associate the first difference between angle measurements with a first bend amount (e.g., an absence of bending in any direction for an un-bent motor assembly 122) of the second motor housing assembly member with respect to the first motor housing assembly member. Further, at the same point in the rotation cycle, the computing device 116 can determine a second set of inclination angle measurements at the respective inclinometers 302, 304 based on a bending of the motor assembly 122. The computing device 116 can determine a second difference between the angle measurements of the respective inclinometers 302, 304. A change in the difference between angle measurements can be used to determine a bend amount for the motor assembly 122.

Figure 4A:
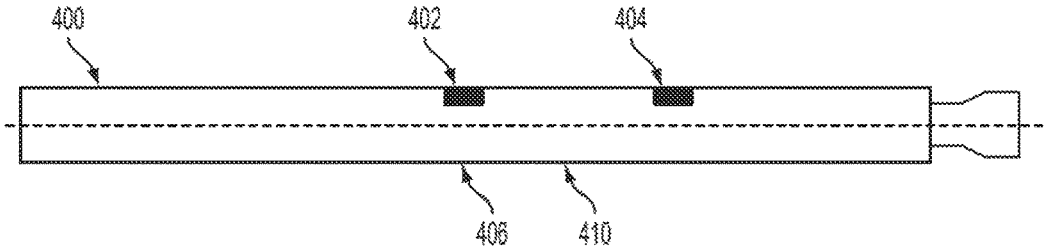
FIG. 4A is a cross-sectional side view of another embodiment of an assembly for determining bend measurements of an adjustable motor assembly using inclinometers in which there is no bend in the adjustable motor assembly according to one aspect of the present disclosure.

FIG. 4A is a cross-sectional side view of another embodiment of an assembly 400 for determining bend measurements of an adjustable motor assembly 400 using inclinometers 402, 404 in which there is no bend in the adjustable motor assembly according to one example. The adjustable motor assembly 400 can include a bendable housing 406. A first inclinometer 402 can be positioned on a first side of a bend location 410 and a second inclinometer 404 can be positioned on a second side of the bend location 410. In one embodiment, the first inclinometer 402 and the second inclinometer 404 are equidistant from the bend location 410. In another embodiment, the first inclinometer 402 and the second inclinometer 404 can be on the outside of the bendable housing 406.

In some embodiments, a multitude of first inclinometers 402 can be positioned on the first side of bend location 410 and a multitude of second inclinometers 404 can be positioned on a second side of bend location 410. In one such embodiment, the multitude of first inclinometers 402 can be equidistant around the circumference of the bendable housing 406 on the first side of the bend location 410 and the multitude of second inclinometers 404 can be equidistant around the circumference of the bendable housing 406 on the second side of the bend location 410.

Figure 4B:
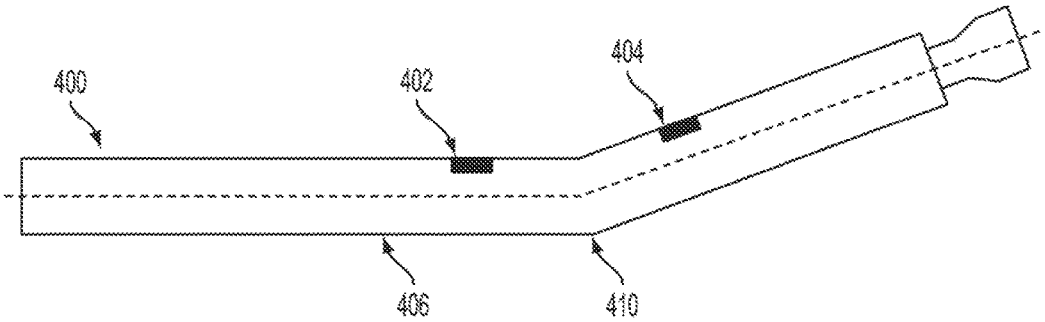
FIG. 4B is a cross-sectional side view of the embodiment in FIG. 4A in which there is a bend in the adjustable motor assembly according to one aspect of the present disclosure.

In the absence of a bend in the housing 406, a first inclination measurement by the inclinometer 402 and a second inclination measurement by the inclinometer 404 measurements may be roughly equal. If housing 406 bends, as shown in FIG. 4B, the inclination of the second inclinometer 404 may change, causing the second inclination measurement by the inclinometer 404 to change. The changed inclination measured by inclinometer 404 can be used to determine the bend direction and bend amount in the adjustable motor assembly 400.

Figure 5:
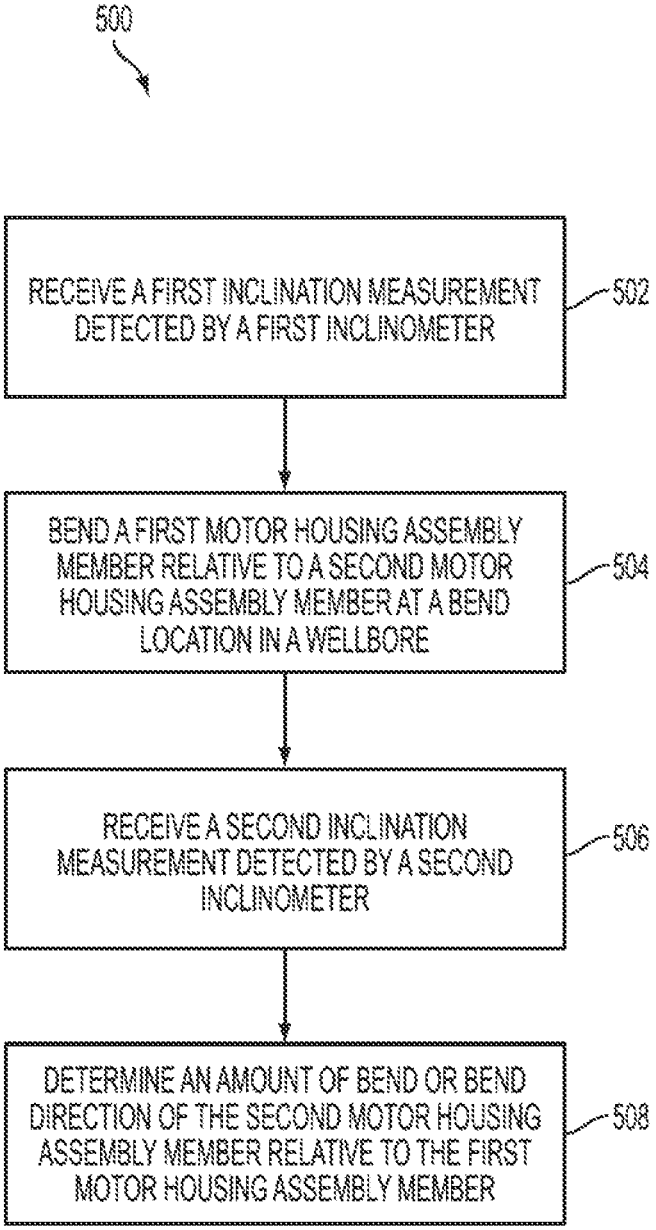
FIG. 5 is an example of a flow chart of a process for determining bend measurements of an adjustable motor assembly using magnetometers according to one embodiment.

FIG. 5 is an example of a flow chart of a process 500 for determining bend measurements of an adjustable motor assembly using inclinometers according to one embodiment.

In block 502, a first inclination measurement detected by a first inclinometer is received. The first inclination measurement can be associated with a motor assembly (such as, but not limited to, the motor assemblies 200, 300, or 400) in which a first motor housing assembly member can bend relative to a second motor housing assembly member. The first inclination measurement can be received by a computing device 116 via a communication device 212. In some embodiments, the first inclination measurement can be obtained in multiple dimensions (e.g., three dimensions). In such embodiments, the first inclination measurement can include both an inclination amount and direction. The first inclination measurement can be used as a baseline measurement against which subsequent inclination measurements can be compared to determine an amount of bend or bend direction of an adjustable motor assembly. The computing device 116 can be located at any suitable location (e.g., at the surface of the wellbore, below ground, or offsite).

In block 504, a first motor housing assembly member bends relative to a second motor housing assembly member at a bend location in a wellbore 112. In one such embodiment, a drill operator can cause the first motor housing assembly member to bend relative to the second motor housing assembly member in order to navigate around a bend in the formation of the wellbore 112. In some embodiments, the first motor housing assembly can bend relative to the second motor housing assembly member automatically in response to encountering a bend in the formation of the wellbore 112. In another embodiment, the drill operator can cause the first motor housing assembly member to bend relative to the second motor housing assembly member to drill along a designated drilling trajectory. As the first motor housing assembly member bends relative to the second motor assembly housing member, the inclination can change. As the distance changes, the inclination measured by one or more inclinometers can change.

In block 506, a second inclination measurement detected by a second inclinometer is received. The second inclination measurement can be received by a computing device 116 via the communication device 212. In some embodiments, the second inclination measurement can be obtained in multiple dimensions (e.g., three dimensions). In such embodiments, the second inclination can include both an inclination amount and direction.

In block 508, the amount of bend and a bend direction of the first motor housing assembly member relative to the second motor housing assembly member is determined. In some embodiments, this determination is performed by a computing device 116. In some embodiments, the bend direction and bend amount can be determined based on a comparison of the baseline first inclination detected to the second inclination detected. The difference between the first inclination and the second inclination can be indicative of the amount of bend and bend direction of the first motor housing assembly member relative to a second motor housing assembly member.

In some embodiments, the computing device 116 can determine the amount of bend and bend direction via a communication device 212 and compare it with a designated drilling trajectory. Should the amount of bend and bend direction determined by the computing device 116 need to be altered to conform with the designated drilling trajectory, the computing device 116 can cause the amount of bend or bend direction of the second motor housing assembly member relative to the first motor housing assembly member to change.

Figure 6:
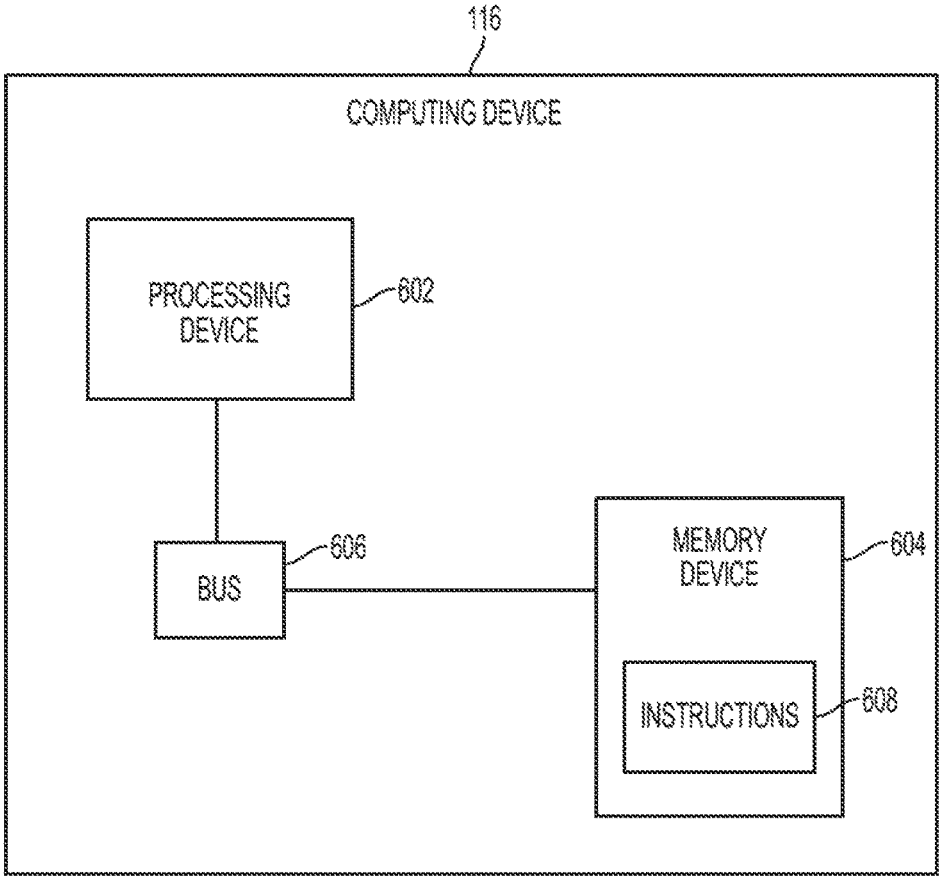
FIG. 6 is a block diagram depicting an example of a computing device for determining bend measurements of an adjustable motor assembly using inclinometers.

FIG. 6 is a block diagram depicting an example of a computing device 116 for determining bend measurements of an adjustable motor assembly using inclinometers. The computing device 116 includes a processing device 602, a memory device 604, and a bus 606.

The processing device 602 can execute one or more operations for determining bend measurements of an adjustable motor assembly using inclinometers. The processing device 602 can execute instructions 608 stored in the memory device 604 to perform the operations. The processing device 602 can include one processing device or multiple processing devices. Non-limiting examples of the processing device 602 include a Field-Programmable Gate Array ("FPGA"), an application-specific integrated circuit ("ASIC"), a microprocessor, etc.

The processing device 602 can be communicatively coupled to the memory device 604 via the bus 606. The non-volatile memory device 604 may include any type of memory device that retains stored information when powered off. Non-limiting examples of the memory device 604 include electrically erasable programmable read-only memory ("ROM"), flash memory, or any other type of non-volatile memory. In some aspects, at least some of the memory device 604 can include a medium from which the processing device 602 can read instructions. A computer-readable medium can include electronic, optical, magnetic, or other storage devices capable of providing the processing device 602 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, etc.

In some aspects, an assembly for determining bend measurements of an adjustable motor assembly using inclinometers is provided according to one or more of the following examples.

Example #1

An assembly for determining bend measurements of an adjustable motor assembly using inclinometers can include a first motor housing assembly member. The assembly can also include a second motor housing assembly member, a first inclinometer, and a second inclinometer. The second motor housing assembly member can be coupled to the first motor housing assembly member and bendable relative to the first motor housing assembly member at a bend location in a wellbore. The first inclinometer can be positioned on a first side of the bend location for determining a first inclination. The second inclinometer can be positioned on a second side of the bend location for determining a second inclination. Based on the first and second inclinations, an amount of bend of the second motor housing assembly member relative to the first motor housing assembly member can be determined.

Example #2

The assembly of Example #1 may feature inclinometers further positioned to determine a bend direction.

Example #3

The assembly of any of Examples #1-2 may feature a communication device to communicate with a computing device.

Example #4

The assembly of any of Examples #1-3 may feature a communication device positioned at the wellbore surface.

Example #5

The assembly of any of Examples #1-4 may feature the first inclinometer coupled to the communication device.

Example #6

The assembly of any of Examples #1-5 may feature the second inclinometer coupled to the communication device.

Example #7

The assembly of any of Examples #1-6 may feature the first motor housing assembly member or the second motor housing assembly member including a motor for drilling a wellbore.

Example #8

The assembly of any of Examples #1-7 may feature the first inclinometer positioned on the exterior of the first motor housing assembly member.

Example #9

The assembly of any of Examples #1-8 may feature the second inclinometer positioned on the exterior of the second motor housing assembly member.

Example #10

The assembly of any of Examples #1-9 may feature the first inclinometer and the second inclinometer located equidistant from the bend location.

Example #11

The assembly of any of Examples #1-10 may feature the first inclinometer being included in a multitude of first inclinometers and the multitude of first inclinometers are equidistantly spaced around a circumference of the first motor housing assembly member.

Example #12

The assembly of any of Examples #1-11 may feature the second inclinometer being included in a multitude of second inclinometers.

Example #13

The assembly of Example #12 may feature the multitude of second inclinometers equidistantly spaced around a circumference of the second motor housing assembly member.

Example #14

The assembly of any of Examples #1-13 may feature a third motor assembly member inside the first motor housing assembly member or the second motor housing assembly member.

Example #15

The assembly of Examples #1-7, 10, 12, or 13-14 may feature a first inclinometer positioned on the third motor assembly member.

Example #16

The assembly of Example #15 may feature a first inclinometer that includes a multitude of first inclinometers that are positioned on the third motor assembly member.

Example #17

The assembly of any of Examples #14-16 may feature a second inclinometer positioned on the third motor assembly member.

Example #18

The assembly of any of Examples #14-17 may feature the third motor assembly member being rotatable around a rotation axis.

Example #19

A method for determining bend measurements of an adjustable motor assembly using inclinometers can include receiving, by a communication device, a first inclination detected by a first inclinometer. A first motor housing assembly member can bend relative to a second motor housing assembly member at a bend location in a wellbore. A second inclination detected by a second inclinometer can be received by a communication device. Finally, the assembly can determine an amount of bend or bend direction of the second motor housing assembly member relative to the first motor housing assembly member based on the first inclination and the second inclination.

Example #20

The method of Example #19 may feature determining, by the computing device, an amount of bend second motor housing assembly member relative to the first motor housing assembly member by associating the first inclination measurement with a first bend amount. The computing device can associate the second inclination measurement with a second bend amount. Further, the computing device can determine the difference between the first inclination and the second inclination.

Example #21

The method of any of Examples #19-20 may feature determining, by the computing device, a bend direction of the second motor housing assembly member relative to the first motor housing assembly member by determining a first inclination in three dimensions based on the first inclination measurement and associating the first inclination in three dimensions with a first bend direction. Also, the computing device can determine a second inclination in three dimensions based on the second inclination measurement and associate the second inclination in three dimensions with a second bend direction. Finally, the computing device can determine the difference between the first bend direction and the second bend direction.

Example #22

The method of any of Examples #19-21 may feature determining if the bend direction and bend amount should be altered to conform with a designated drilling trajectory. Further, the method may feature causing the amount of bend or bend direction of the second motor housing assembly member relative to the first motor housing assembly member to change.

Example #23

A computing device for determining bend measurements of an adjustable motor assembly using inclinometers can include a processing device and a memory. The memory can include instructions executable by the processing device. The instructions can include receiving, by a communication device, a first inclination detected by a first inclinometer. Further, the instructions can include receiving a second inclination detected by a second inclinometer, and determining an amount of bend or bend direction of the second motor housing assembly member relative to the first motor housing assembly member based on the first inclination and second inclination.

Example #24

The computing device of Example #23 may feature instructions for associating the first inclination measurement with a first bend amount and associating the second inclination measurement with a second bend amount. The computing device may further feature instructions for determining the difference between the first inclination and the second inclination.

Example #25

The computing device of any of Examples #23-24 may feature instructions for determining a first inclination in three dimensions based on the first inclination measurement and associating the first inclination in three dimensions with a first bend direction. The computing device may further feature instructions for determining a second inclination in three dimensions based on the second inclination measurement and associating the second inclination in three dimensions with a second bend direction. Finally, the computing device may feature instructions for determining the difference between the first bend direction and the second bend direction.

Example #26

The computing device of any of Examples #23-25 may feature instructions for determining if the amount of bend or bend direction should be altered to conform with a designated drilling trajectory and causing the amount of bend or bend direction of the second motor housing assembly member relative to the first motor housing assembly member to change.

The foregoing description of certain embodiments, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly usable with a drill string in a wellbore, the assembly comprising:

a first motor housing assembly member that houses a drilling motor for drilling the wellbore, wherein the first motor housing assembly member comprises a first inclinometer for determining a first inclination of the first motor housing assembly member;

a second motor housing assembly member coupled to the first motor housing assembly member at a bend location and bendable relative to the first motor housing assembly member, wherein the second motor housing assembly member also houses the drilling motor, and wherein the second motor housing assembly member comprises a second inclinometer for determining a second inclination of the second motor housing assembly member; and a third motor assembly member that is (i) positioned inside the first motor housing assembly member and comprises the first inclinometer, or (ii) positioned inside the second motor housing assembly member and comprises the second inclinometer;

wherein the first inclination and second inclination are usable to determine an amount of bend of the second motor housing assembly member relative to the first motor housing assembly member.

2. The assembly of claim 1, wherein the first inclinometer is positioned on the first motor housing assembly members, respectively to determine a bend direction.

3. The assembly of claim 1, further comprising a communication device to communicate with a computing device.

4. The assembly of claim 3, wherein the computing device is positioned at a surface of the wellbore.

5. The assembly of claim 3, wherein the first inclinometer is coupled to the communication device and the second inclinometer is coupled to the computing device.

6. The assembly of claim 3, further comprising the computing device, the computing device operable to determine at least one of the amount of bend or a bend direction based on measurements of the first and second inclinations.

7. The assembly of claim 1, wherein the first inclinometer is positioned on an exterior of the first motor housing assembly member.

8. The assembly of claim 1, wherein the first inclinometer and the second inclinometer are equidistant from the bend location.

9. The assembly of claim 1, wherein the first inclinometer is included in a plurality of first inclinometers and the plurality of first inclinometers are equidistant around a circumference of the first motor housing assembly member.

10. The assembly of claim 1, wherein the second inclinometer is included in a plurality of second inclinometers.

11. The assembly of claim 10, wherein the plurality of second inclinometers are equidistant around a circumference of the second motor housing assembly member.

12. The assembly of claim 1, wherein the first inclinometer is positioned on the third motor assembly member.

13. The assembly of claim 1, wherein the first inclinometer is a plurality of first inclinometers that are positioned on the third motor assembly member.

14. The assembly of claim 1, wherein the second inclinometer is positioned on the third motor assembly member.

15. The assembly of claim 1, wherein the third motor assembly member is rotatable around a rotation axis.

16. The assembly of claim 1, wherein the third motor assembly member is a mandrel.

17. A method comprising:

receiving, by a computing device, a first inclination measurement detected by a first inclinometer coupled to a motor assembly member that is positioned inside a first motor housing assembly member of a drill string, wherein the first motor housing assembly member houses a drilling motor for drilling a wellbore;

bending the first motor housing assembly member relative to a second motor housing assembly member of the drill string, wherein the second motor housing assembly member also houses the drilling motor;

receiving, by the computing device, a second inclination measurement detected by a second inclinometer coupled to the second motor housing assembly member; and determining, by the computing device, an amount of bend or bend direction of the second motor housing assembly member relative to the first motor housing assembly member based on the first and second inclination measurements.

18. The method of claim 17, wherein determining, the amount of bend of the second motor housing assembly member relative to the first motor housing assembly member comprises:

associating the first inclination measurement with a first bend amount;

associating the second inclination measurement with a second bend amount; and determining a difference between the first inclination and the second inclination.

19. The method of claim 17, wherein determining, the bend direction of the second motor housing assembly member relative to the first motor housing assembly member comprises:

determining a first inclination in three dimensions based on the first inclination measurement;

associating the first inclination in three dimensions with a first bend direction;

determining a second inclination in three dimensions based on the second inclination measurement;

associating the second inclination in three dimensions with a second bend direction; and determining a difference between the first bend direction and the second bend direction.

20. The method of claim 17, further comprising:

determining that the bend direction and the amount of bend should be altered to conform with a designated drilling trajectory; and changing the amount of bend and the bend direction of the second motor housing assembly member relative to the first motor housing assembly member.

21. The method of claim 17, wherein the motor assembly member is a mandrel.

22. A computing device comprising:

a processing device; and a memory device including instructions that are executable by the processing device for causing the processing device to:

receive a first inclination measurement detected by a first inclinometer coupled to a motor assembly member that is positioned inside a first motor housing assembly member of a drill string, wherein the first motor housing assembly member houses a drilling motor for drilling a wellbore;

receive a second inclination measurement detected by a second inclinometer coupled to a second motor housing assembly member of the drill string, wherein the second motor housing assembly member also houses the drilling motor and is bendable relative to the first motor housing assembly member; and determine an amount of bend or a bend direction of the second motor housing assembly member relative to the first motor housing assembly member based on the first and second inclination measurements.

23. The computing device of claim 22, wherein the memory device further includes instructions that are executable by the processing device for causing the processing device to:

determine a first bend amount based on the first inclination measurement;

determine a second bend amount based on the second inclination measurement; and determine a difference between the first bend amount and the second bend amount to determine the amount of bend between the second motor housing assembly member and the first motor housing assembly member.

24. The computing device of claim 22, wherein the memory device further includes instructions that are executable by the processing device for causing the processing device to:

determine a first inclination in three dimensions based on the first inclination measurement;

associate the first inclination in three dimensions with a first bend direction;

determine a second inclination in three dimensions based on the second inclination measurement;

associate the second inclination in three dimensions with a second bend direction; and determine a difference between the first bend direction and the second bend direction.

25. The computing device of claim 22, wherein the memory device further includes instructions that are executable by the processing device for causing the processing device to:

determine that the amount of bend should be altered to conform with a designated drilling trajectory; and cause the amount of bend between the second motor housing assembly member and the first motor housing assembly member to change.

* * * * *